US009008549B2

(12) United States Patent
Fujimoto

(10) Patent No.: US 9,008,549 B2
(45) Date of Patent: Apr. 14, 2015

(54) COMPACT IMAGE FORMING APPARATUS WITH SIMPLIFIED COVER

(71) Applicant: Takashi Fujimoto, Hyogo (JP)

(72) Inventor: Takashi Fujimoto, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 97 days.

(21) Appl. No.: 13/763,889

(22) Filed: Feb. 11, 2013

(65) Prior Publication Data

US 2013/0251398 A1 Sep. 26, 2013

(30) Foreign Application Priority Data

Mar. 22, 2012 (JP) ..... 2012-064802

(51) Int. Cl.
*G03G 21/00* (2006.01)
*G03G 21/16* (2006.01)

(52) U.S. Cl.
CPC ..... *G03G 21/1633* (2013.01)

(58) Field of Classification Search
CPC ..... G03G 21/1633; G03G 2221/169
USPC ..... 399/124; 16/374, 375, 377
See application file for complete search history.

(56) References Cited

U.S. PATENT DOCUMENTS

| | | | | |
|---|---|---|---|---|
| 4,259,762 | A * | 4/1981 | Civitelli | 16/86 B |
| 5,121,521 | A * | 6/1992 | Hagiwara et al. | 16/278 |
| 6,216,316 | B1 * | 4/2001 | Errichiello | 16/246 |
| 7,386,255 | B2 * | 6/2008 | Ochi | 399/121 |
| 7,684,731 | B2 * | 3/2010 | Hirose et al. | 399/124 |
| 8,634,743 | B2 * | 1/2014 | Akaike et al. | 399/110 |
| 2007/0147882 | A1 * | 6/2007 | Igarashi | 399/110 |

FOREIGN PATENT DOCUMENTS

| | | |
|---|---|---|
| JP | 2001-039602 | 2/2001 |
| JP | 2006-284805 | 10/2006 |
| JP | 2010-014813 | 1/2010 |

* cited by examiner

*Primary Examiner* — Clayton E Laballe
*Assistant Examiner* — Leon W Rhodes, Jr.
(74) *Attorney, Agent, or Firm* — Harness, Dickey & Pierce, P.L.C.

(57) ABSTRACT

An image forming apparatus includes a structure having an image formation device to form an image, a cover pivotally attached to the structure around a rotary shaft, and an opening angle restricting device to restrict an opening angle of the cover regarding the structure. The opening angle restricting device includes a pivotable cover rotation restriction member coaxially arranged with the rotary shaft to contact a downstream side of the pivotable cover in a cover opening direction at its first end to restrict the rotation of the pivotable cover in the opening direction.

19 Claims, 11 Drawing Sheets

COMPACT IMAGE FORMING APPARATUS WITH SIMPLIFIED COVER

CROSS-REFERENCE TO RELATED APPLICATION

This patent application is based on and claims priority pursuant to 35 U.S.C. §119 to Japanese Patent Application No. 2012-064802, filed on Mar. 22, 2012 in the Japan Patent Office, the entire disclosure of which is hereby incorporated by reference herein.

BACKGROUND

1. Technical Field

The present invention relates to an image forming apparatus, such as a copier, a printer, a facsimile machine, etc.

2. Related Art

In a conventional image forming apparatus, an image forming unit, such as a photoconductor unit, an intermediate transfer unit, etc., is included in a structure of an apparatus main body and is attached and detached to and from the structure by opening a pivotable cover to execute maintenance and replacement of the image forming unit or the like.

According to an image forming apparatus described in Japanese Patent Application Publication No. 2010-14813 (JP-2010-14813-A), by opening a pivotable cover openably attached to a structure of an apparatus main body around a rotary shaft, a photoconductor unit is detached from the structure.

JP-2010-14813-A also describes an opening angle rotation restricting device for restricting an opening angle of the pivotable cover to a prescribed angle. Specifically, a damper is provided to limit swinging of the pivotable cover in an opening direction. One end of the damper is supported by a widthwise end of the structure around a shaft, while the other end thereof is supported by a widthwise end of the pivotable cover around another shaft. Thus, when the pivotable cover is opened and the damper is suspended between the structure and the pivotable cover, the pivotable cover does not open restricting the opening angle of the pivotable cover regarding the structure.

However, when the pivotable cover is opened regarding the structure, the damper occupies a space at the widthwise end of the structure between the pivotable cover and the structure by an amount equal to a width of the damper. Therefore, to attach and detach the photoconductor unit to and from the structure while preventing the photoconductor unit from interfering with the damper, the sum of a width of the photoconductor unit and the width of the damper is required as a width of the structure, thereby enlarging the image forming apparatus as a problem.

SUMMARY

Accordingly, the present invention provides a novel image forming apparatus that comprises a structure having an image formation device to form an image, a cover pivotally attached to the structure around a rotary shaft, and an opening angle restricting device to restrict an opening angle of the cover regarding the structure. The opening angle restricting device includes a pivotable cover rotation restriction member coaxially provided with the rotary shaft to contact a downstream side of the pivotable cover in a cover opening direction at its first end to restrict the rotation of the pivotable cover in the opening direction.

In another aspect of the present invention, the pivotable cover rotation restriction member further includes a second end contacting a contact surface provided in the structure, the second end being arranged on an opposite side of the rotary shaft to the first end. When the pivotable cover is opened and the first end of the pivotable cover rotation restriction member contacts the downstream side of the pivotable cover in the cover opening direction, the pivotable cover rotation restriction member is pressed and rotated by the pivotable cover around the rotary shaft, while the second end of the pivotable cover rotation restriction member contacts the contact surface of the structure and stops rotating and supports the pivotable cover by restricting rotation and an opening angle of the pivotable cover in the opening direction regarding the structure.

In yet another aspect of the present invention, the pivotable cover rotation restriction member has a prescribed shape determining a relation that a portion of the first end is heavier than a portion of the second end across the rotary shaft.

In yet another aspect of the present invention, the pivotable cover rotation restriction member has a prescribed shape determining a relation that a portion of the first end is lighter than a portion of the second end. The structure includes a protrusion section is provided to contact and restrict rotation of the pivotable cover rotation restriction member when the pivotable cover is closed.

In yet another aspect of the present invention, a spring is provided to connect the pivotable cover rotation restriction member with the pivotable cover to cause an angular moment on the one side of the pivotable cover rotation restriction member around the rotary shaft. The pivotable cover rotation restriction member is shaped so that a portion of the first end is lighter than a portion of the second end across the rotary shaft.

In yet another aspect of the present invention, an elastic member is disposed at at least one of a first contact point on the downstream side of the pivotable cover in its opening direction contacted by the pivotable cover rotation restriction member, and a second contact point on the contact surface of the structure contacted by the pivotable cover rotation restriction member.

In yet another aspect of the present invention, the pivotable cover rotation restriction member includes a plate spring contacting the downstream side of the pivotable cover in its opening direction when the pivotable cover is opened.

In yet another aspect of the present invention, multiple holes are formed in the pivotable cover, the structure, and the pivotable cover rotation restriction member, respectively, to collectively accept insertion of the rotary shaft when assembled. A holder section is disposed in the pivotable cover to hold the pivotable cover rotation restriction member to align the respective holes of the pivotable cover, the structure, and the pivotable cover rotation restriction member on the same linear line, substantially.

In yet another aspect of the present invention, an opening angle adjusting device is provided to adjust the opening angle of the pivotable cover regarding the structure restricted by the opening angle rotation restricting device.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 2:
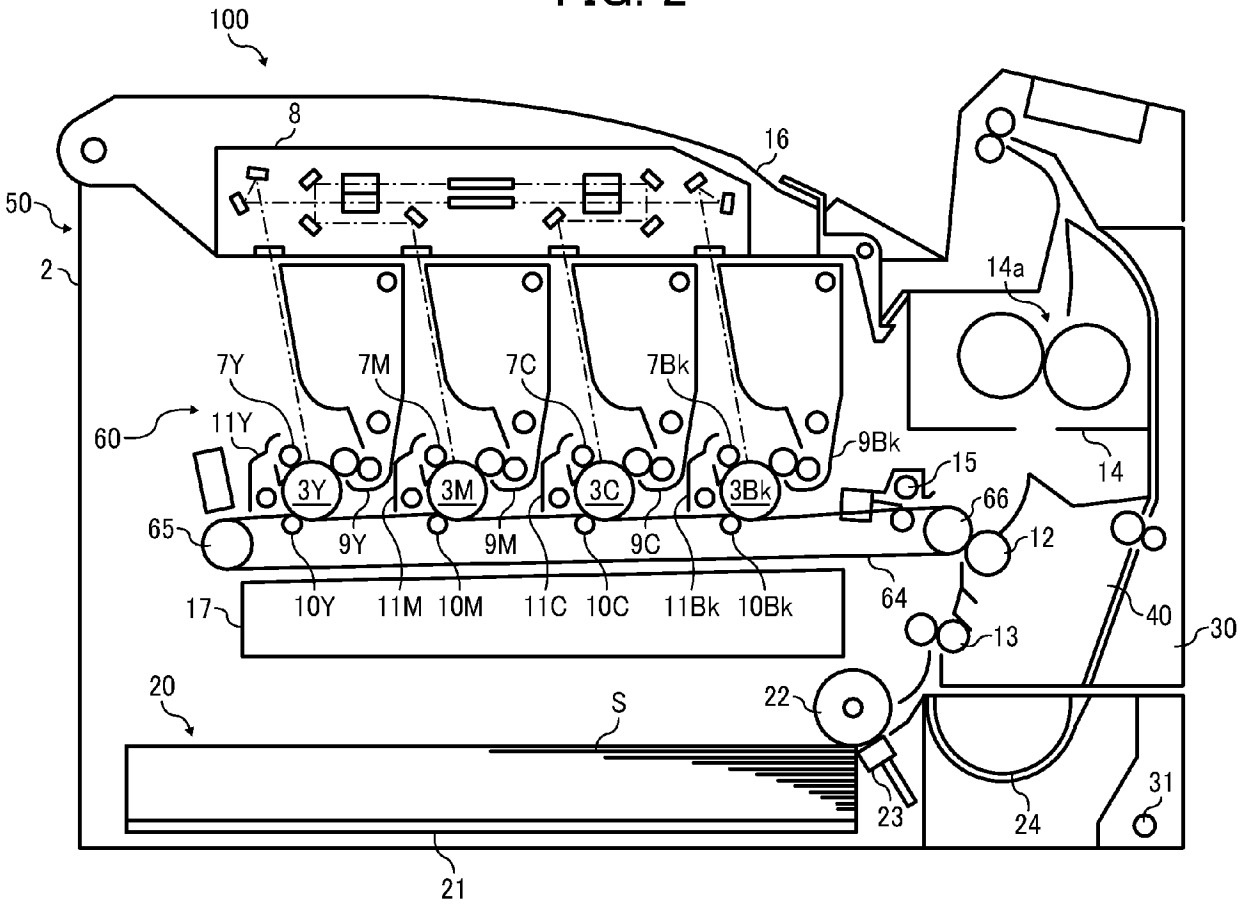
FIG. 2 is a schematic diagram illustrating a printer according to one embodiment of the present invention.

Referring now to the drawings, wherein like reference numerals designate identical or corresponding parts throughout the several views thereof and in particular to FIG. 2, a schematic configuration of a printer 100 as an image forming apparatus according to one embodiment of the present invention is described. The printer 100 of this embodiment is a color printer of a tandem type with an image forming unit 60 located at a center of an apparatus main body 50 and a sheet feeding unit 20 located below the image forming unit 60 to feed a sheet to form an image thereon by the image formation unit 60.

In the image formation unit 60, multiple drum-shaped photoreceptors 3Y, 3M, 3C, and 3Bk are provided as image carriers. Each of the photoreceptors 3Y, 3M, 3C, and 3Bk forms a toner image having a different color. In an illustrated example, yellow, cyan, magenta, and black toner images are formed in respective surfaces of the photoreceptors 3Y, 3C, 3M, and 3Bk. Each of the photoreceptors 3Y, 3M, 3C, and 3Bk is placed parallel to each other at a prescribed interval. An intermediate transfer belt 64 is located being opposed to lower sections of these photoconductors 3Y, 3M, 3C, and 3Bk as an intermediate transfer member. Here, as the intermediate transfer member, a drum type can be used. However, as illustrated in the drawing, an endless belt wound around multiple support rollers 65 and 66 is typically driven in a direction as shown by arrow in the drawing.

On the peripheries of the respective photoreceptors 3Y, 3Y, 3C, 3M, and 3Bk, there are provided charging devices 7Y, 7M, 7C, and 7Bk each for applying a charging process to the surface of each of the photoreceptors 3Y, 3Y, 3C, 3M, and 3Bk. An exposure unit 8 is provided to expose the photosensitive surfaces with laser light based on image information. Also provided on the peripheries are developing devices 9Y, 9M, 9C, and 9Bk for developing latent images formed on the surfaces of the photoconductors 3Y, 3C, 3M, and 3Bk after the exposure of the exposure unit 8 with toner included in developer to visualize the latent images into toner image, multiple primary transfer rollers 10Y, 10 M, 10C, and 10Bk respectively facing the photoconductors 3Y, 3M 3C, and 3Bk via the intermediate transfer belt 64, and cleaning devices 11Y, 11M, 11C, and 11Bk for removing residual toner remaining on the surfaces of the photoconductors 3Y, 3C, 3M, and 3Bk after respective transfer processes executed onto the intermediate transfer belt 64.

When image formation starts in the printer 100, the photoreceptors 3Y, 3M, 3C, and 3Bk are driven and rotated clockwise in the drawing. At this moment, the surfaces of the respective photoreceptors 3Y, 3M, 3C, 3BK are charged by the charging devices 7Y, 7M, 7C, and 7Bk each to have a prescribed polarity. Subsequently, laser light is emitted from the exposure device 8 to the charged surface based on image information, so that a latent image is formed on each of the photoconductors 3Y, 3M, 3C, and 3Bk. Further, the latent images formed on the surfaces of the photoconductors 3Y, 3C, 3M, and 3Bk are visualized by the developing devices 9Y, 9M, 9C, and 9Bk as toner images. The toner images are then transferred by the primary transfer rollers 10Y, 10M, 10C, and 10Bk, to each of which a bias is applied from a power source, not shown, onto the intermediate transfer belt 64 from the photoconductors 3Y, 3M, 3C, and 3Bk, respectively. Residual toner adhering to the surface of each of the photoreceptors 3Y, 3M, 3C, and 3Bk after transferring of the toner image is removed by each of cleaning devices 11Y, 11M, 11C, and 11Bk, respectively, and is collected in a waste toner tank 17 disposed below the intermediate transfer belt 64.

When a color image is formed, the above-described image formation process is executed in all of the photoreceptors 3Y, 3M, 3C, and 3Bk. Thus, yellow, cyan, magenta, and black toner images formed on the respective photoconductors 3Y, 3M, 3C, and 3Bk are transferred and superimposed in an order onto the intermediate transfer belt 64. Further, in the printer 100, a secondary transfer roller 12 is deployed facing a support roller 66 across the intermediate transfer belt 64. A bias is applied from a power source, not shown, to the secondary transfer roller 12.

On the other hand, in the sheet feeding unit 20 placed below the image formation unit 60, there are provided a sheet feeding tray 21 to stack sheets S consisting of transfer sheets or plastic films and the like, a feeding roller 22 that launches a sheet S stacked on the sheet feeding tray 21, a Friction pad 23 as an isolation member to isolate double fed sheets, and a re-conveyance path 24 used when a double-sided image is formed. Furthermore, the isolated member can be a reverse roller employing a torque limiter system.

The sheet S fed from the sheet feeding unit 20 is further sent toward the pair of registration rollers 13 and collides and stops being aligned there. The pair of registration rollers 13 resumes rotation at a prescribed timing to cause a tip of the sheet S to synchronize with the color toner image formed on the intermediate transfer belt 64 in a secondary transfer station in which the secondary transfer roller 12 and the intermediate transfer belt 64 contact each other, and feeds the sheet S toward the second transfer unit.

The sheet S with the toner image thus transferred in the secondary transfer station is sent to the fixing device 14 having a fixing roller 14*a*, and the toner image is fixed onto the sheet S. The sheet S is exhausted thereafter onto a sheet loading section 16 provided on the top of the apparatus main body 50. Toner remaining and attaching to the surface of the intermediate transfer belt 64 after the transferring process of the toner image is removed by the cleaning device 15 and is collected in the waste toner tank 17.

Figure 3:
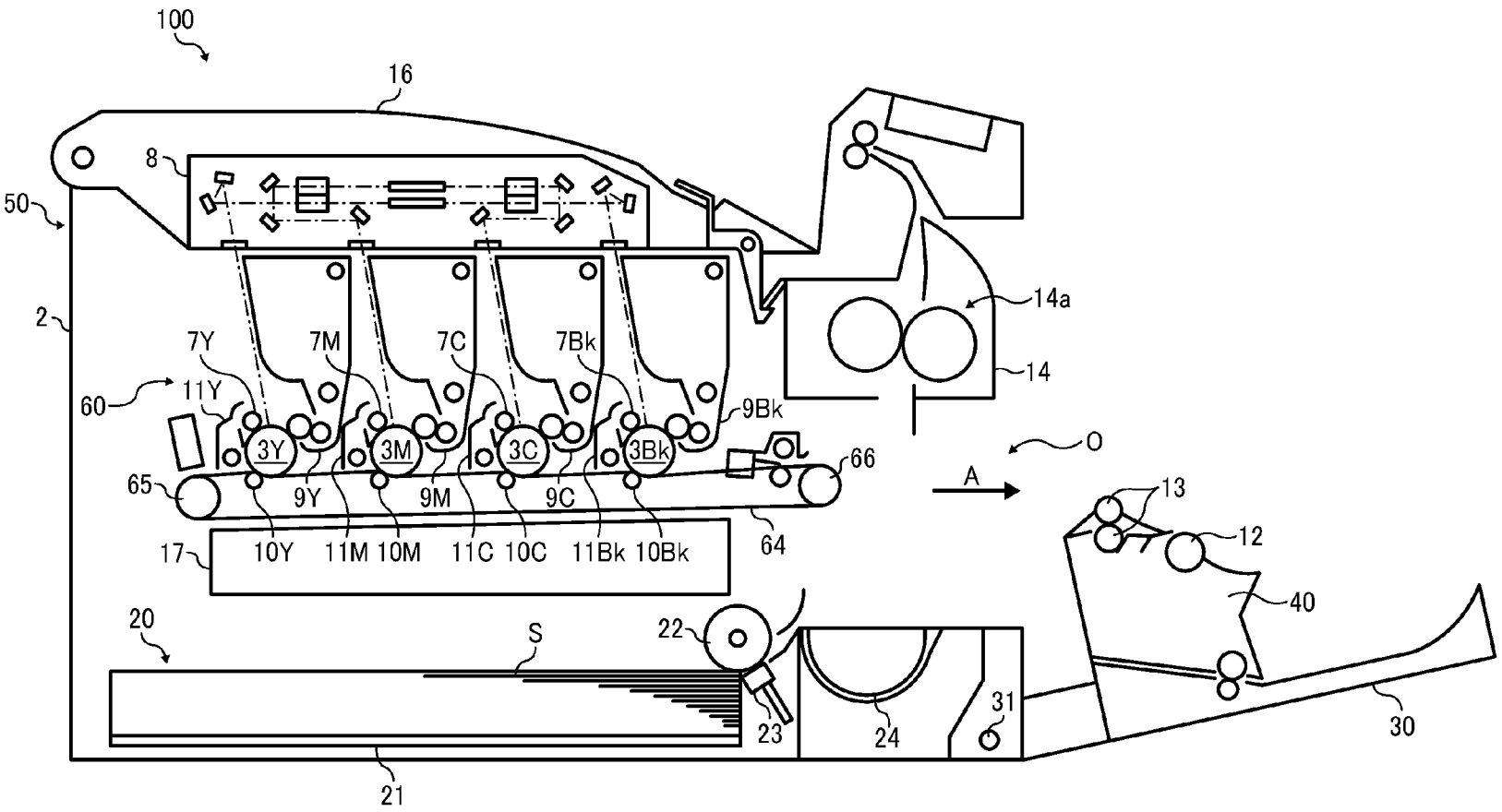
FIG. 3 is a schematic diagram illustrating a configuration of the printer with the front cover opened.

In the printer 100 shown in FIG. 2, a right side thereof corresponds to a front side of the printer 100. A front frame of the apparatus main body 50, i.e., a front cover 30 as an pivotable member is capable of pivotable movement around a fulcrum 31 between a closed position as shown in FIG. 2 and an open position as shown in FIG. 3. A unit mainly consisting of several parts is installed in the front cover 30. In this embodiment, the unit is a conveyance unit 40 with the pair of registration rollers 13 that conveys sheets fed from the sheet feeding unit 20 toward the secondary transfer station. Further, the conveyance unit 40 includes the pair of registration rollers 13, the secondary transfer roller 12, one of guide plates of a re-conveyance path 24.

When maintaining the intermediate transfer belt 64 or detaching or attaching the waste toner tank 17 from or to the printer 100 organized in this way, the front cover 30 is opened as shown in FIG. 3. For example, the intermediate transfer belt 64 is ejected by sliding an intermediate transfer unit including the intermediate transfer belt 64 and the cleaning device 15 in a direction as shown by arrow A in the drawing from the opening O.

Figure 4:
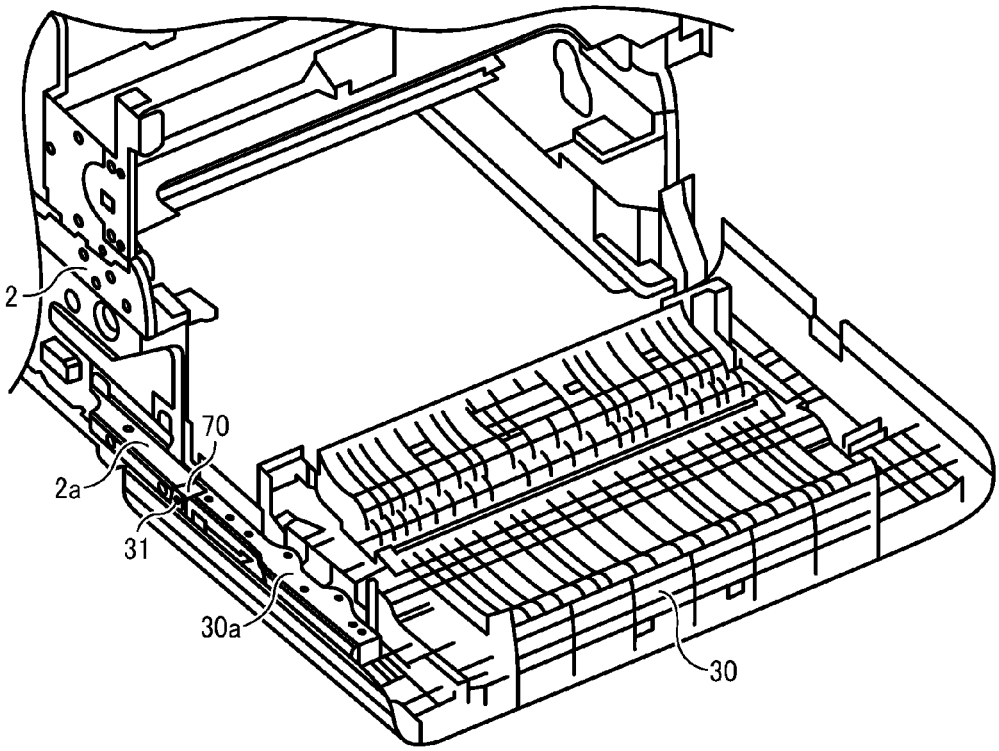
FIG. 4 is a schematic perspective view illustrating an image forming apparatus when the front cover thereof is opened.

FIG. 4 is a schematic perspective view illustrating the printer 100 when a front cover thereof is opened. The front cover 30 is swingably held by a structure 2 of the printer 100 around a fulcrum 31 thereof. The front cover 30 is closed when the printer 100 is operating. When a replacement unit, such as a waste toner case, an intermediate transfer body, etc., is replaced, the front cover 30 is opened as shown in FIG. 4.

Figure 1:
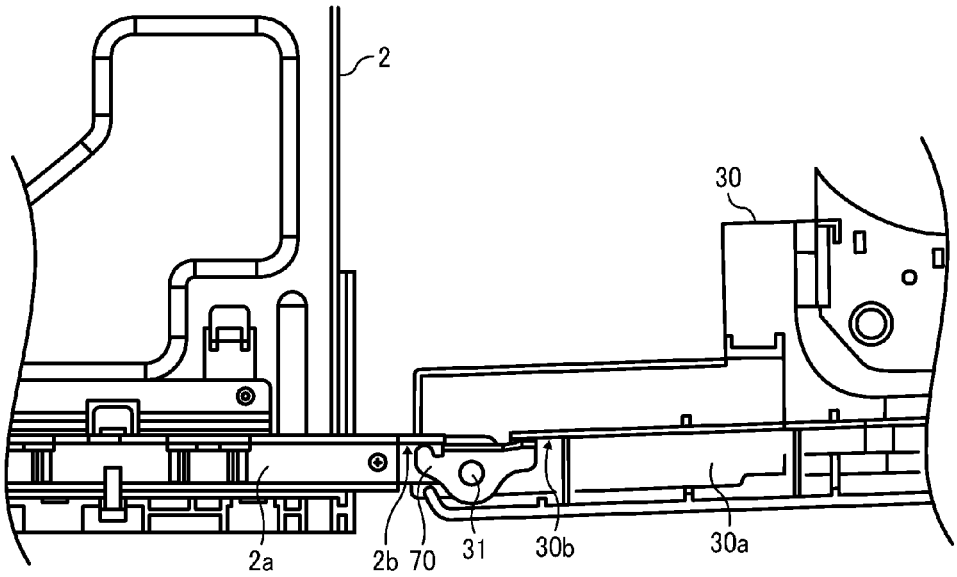
FIG. 1 is an enlarged view illustrating a rotation restriction member and its vicinity when a front cover is opened.

A rotation restriction member 70 is swingably held around the fulcrum 31 when the front cover 30 is opened to restrict an angle of the front cover 30 as shown in FIG. 1.

Figure 5A:
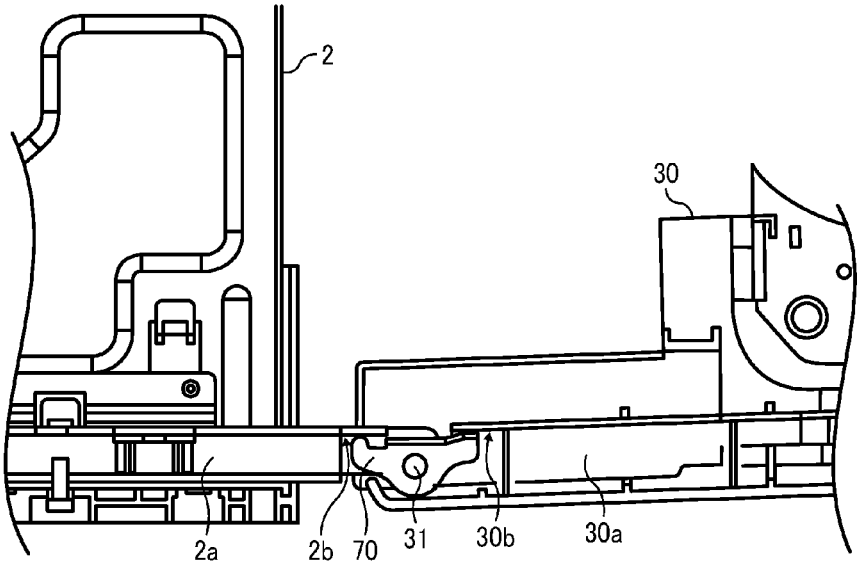
FIG. 5A is a side view illustrating the rotation restriction member and its vicinity when the front cover is opened.

Further, as shown in FIG. 5A, when the front cover 30 is released (i.e., opened), the rotation restriction member 70 and a contact surface 2*b* of a structure front cover holding section 2*a* contact each other, while the rotation restriction member 70 and a contact surface 30*b* of the front cover frame 30*a* contact each other. Specifically, the rotation restriction member 70 is configured to bear the weight of the front cover 30. With this, an opening angle of the front cover 30 is restricted.

Figure 5B:
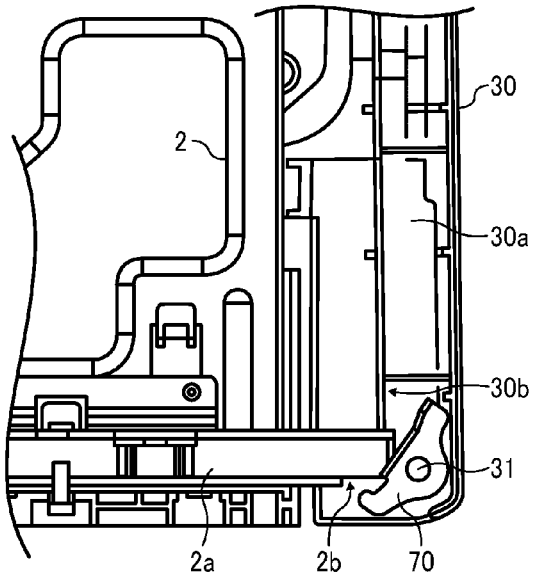
FIG. 5B is a side view illustrating the rotation restriction member and its vicinity when the front cover is closed.

On the other hand, when the front cover 30 is closed from an opening state, the rotation restriction member 70 rotates around the fulcrum 31 and assumes a posture as shown in FIG. 5B. Thus, even when the fulcrum 31 is disposed close to an edge of the front cover 30 and the front cover 30 is closed, the rotation restriction member 70 is not exposed from the front cover 30.

Figure 6A:
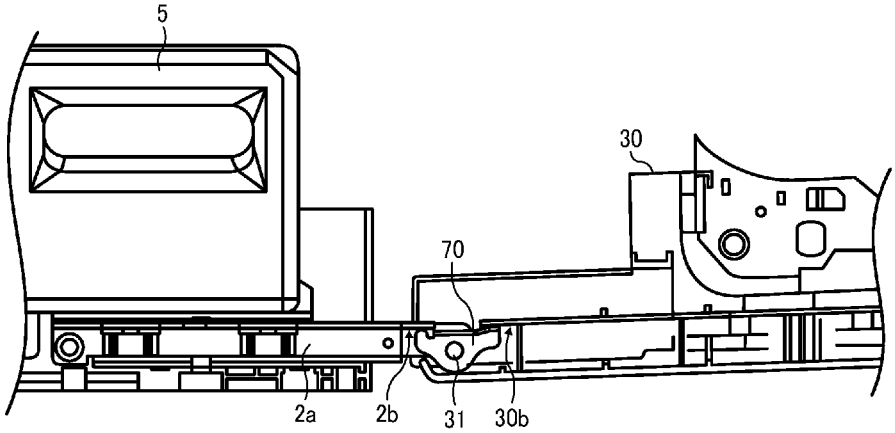
FIG. 6A illustrates an aspect in which a replacement unit is located on a structure side when the front cover is opened.
Figure 6B:
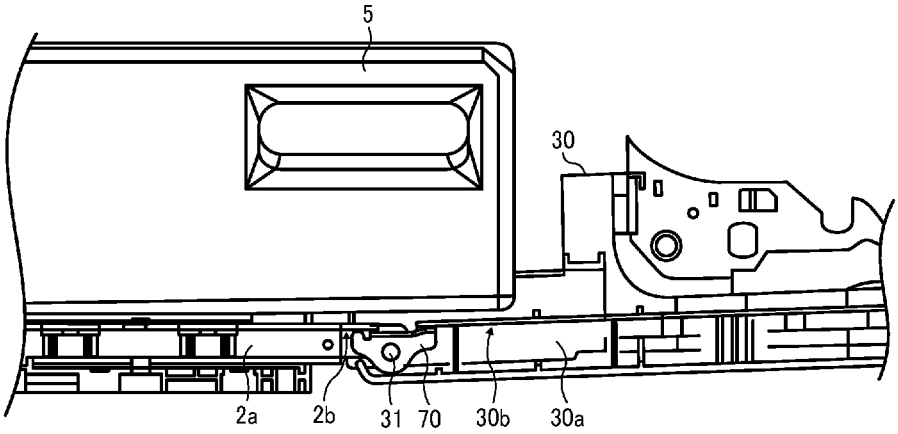
FIG. 6B illustrates an aspect in which the replacement unit is partially moved toward the front cover side from the structure side when the front cover is opened.

Further, as shown in FIG. 6A, the rotation restriction member 70 is located below the contact surface 30*b* of the front cover 30 when the front cover is opened. With this, as shown in FIG. 6B, a space above the fulcrum 31 is widely used as a replacement area for the replacement unit 5.

Figure 7:
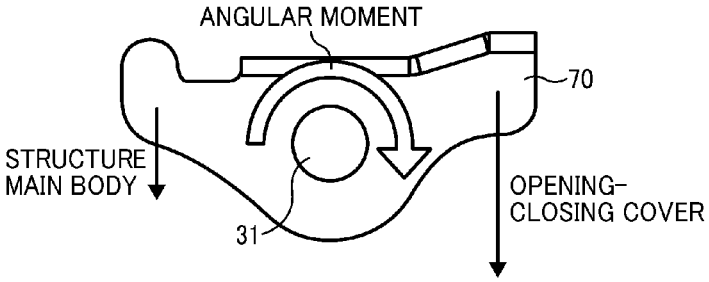
FIG. 7 is a side view illustrating the rotation restriction member according to one embodiment of the present invention.

FIG. 7 is a side view of the rotation restriction member 70. When a shape of the rotation restriction member 70 determines that weight of a front cover side of the rotation restriction member 70 is heavier than that of a structure side thereof located across the fulcrum 31, an angular moment works on the rotation restriction member 70 clockwise around the fulcrum 31 as shown in FIG. 7.

Now, an aspect when the front cover 30 is closed regarding the structure 2 is described on condition that the shape of the rotation restriction member 70 determines that weight of the front cover side of the rotation restriction member 70 is heavier than that of the structure side thereof located across the fulcrum 31.

When the front cover 30 becomes a closed state from the opening state, the rotation restriction member 70 and the contact surface 2*b* keep contact each other from the opening state until the front cover 30 and the structure make a given angle therebetween. Then, the front cover 30 swinging in a closing direction around the fulcrum 31 contacts the rotation restriction member 70, and depresses the rotation restriction member 70. Thus, the rotation restriction member 70 starts rotation counterclockwise as shown in FIG. 7 around the fulcrum 31. When the front cover 30 is closed regarding the apparatus main body, the rotation restriction member 70 keeps its own posture contacting the front cover 30.

Thus, as shown in FIG. 5, an end of the rotation restriction member 70 on the structure side is not exposed from the front cover 30, so that the rotation restriction member 70 can be housed within the front cover 30.

Whereas, when a shape of the rotation restriction member 70 determines that weight of the front cover side of the rotation restriction member 70 lighter than that of the structure side thereof located across the fulcrum 31, an angular moment works on the rotation restriction member 70 counterclockwise around the fulcrum 31 as shown in FIG. 7.

Now, an aspect when the front cover 30 is closed regarding the structure 2 is described on condition that the rotation restriction member 70 having a shape determining a relation that weight of the front cover side of it is lighter than that of the structure side located across the fulcrum 31 is described with reference to FIGS. 8A, 8B, and 8C.

Figure 8A:
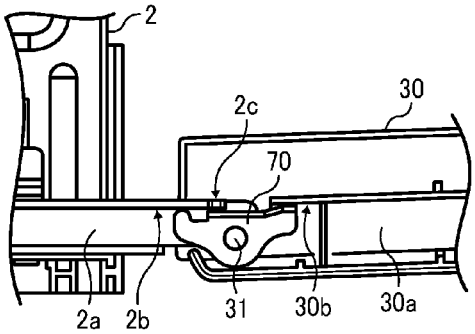
FIG. 8A is a diagram illustrating an aspect when the front cover is opened.
Figure 8B:
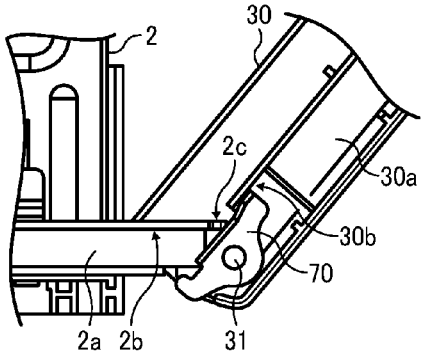
FIG. 8B is a diagram illustrating an aspect when the front cover is closing.
Figure 8C:
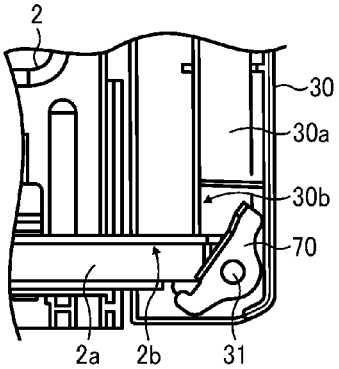
FIG. 8C is a diagram illustrating an aspect when the front cover has been closed.

As shown in FIG. 8A, a protrusion section 2*c* is formed in the structure front cover holding section 2*a*. Thus, when the front cover 30 becomes the closed state from the opening state, the rotation restriction member 70 rotates contacting the contact surface 30*b* until the front cover 30 has been closed by a given angle. Subsequently, the rotation of the rotation restriction member 70 is stopped when it contacts the protrusion section 2*c* as shown in FIG. 8B. Subsequently, the front cover 30 is closed maintaining a current posture of the rotation restriction member 70 as shown in FIGS. 8B and 8C.

Hence, as shown there, the rotation restriction member 70 can be housed within the front cover 30 without an end of the structure side of the rotation restriction member 70 being exposed from the front cover 30.

Now, another aspect when the front cover 30 is closed regarding the structure 2 on condition that the rotation restriction member 70 is shaped so that weight of the front cover side is lighter than that of the structure side located across the fulcrum 31 is described with reference to FIGS. 9A to 9C.

Figure 9A:
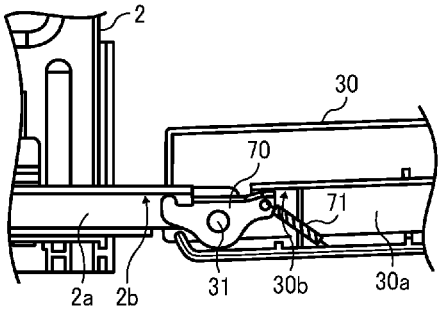
FIG. 9A is a diagram illustrating an aspect when the front cover is opened.
Figure 9B:
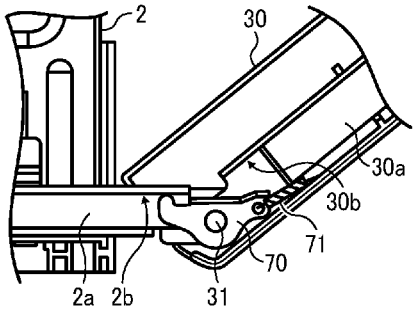
FIG. 9B is a diagram illustrating an aspect when the front cover is closing.

As shown in FIG. 9A, the rotation restriction member 70 and the front cover 30 are connected to each other by a tension spring 71. Thus, an angular moment is working clockwise on the rotation restriction member 70 around the fulcrum 31 due to the tension spring 71 when the front cover 30 is opened as shown in FIG. 7. When the front cover 30 is closed from this state, the rotation restriction member 70 keeps its posture contacting the contact surface 2*b* while receiving the angular moment from the tension spring 71 until the front cover 30 makes a given angle. After that, when the angular moment on the rotation restriction member 70 applied from the tensile spring 71 disappears due to a relative change in angle formed between the rotation restriction member 70 and the front cover 30 as shown in FIG. 9B, the rotation restriction member 70 leaves the contact surface 2*b*. Further, when the front cover 30 is completely closed, the rotation restriction member 70 is brought to a state as shown FIG. 9C.

Figure 9C:
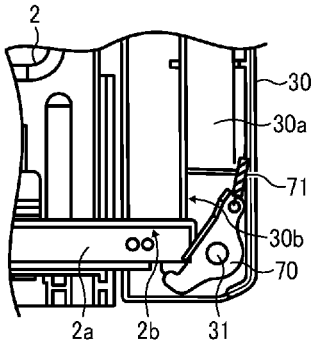
FIG. 9C is a diagram illustrating an aspect when the front cover has been closed.

Hence, as shown in FIG. 9C, the rotation restriction member 70 can be housed within the front cover 30 without an end of the rotation restriction member 70 on the structure side being exposing from the front cover 30.

Figure 10:
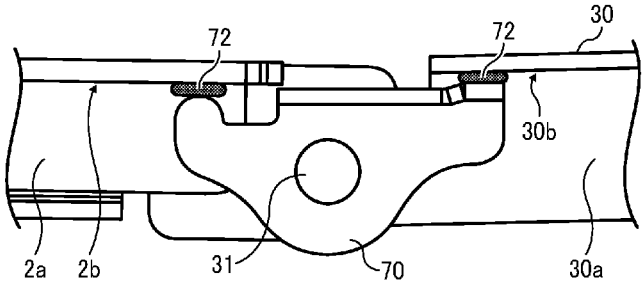
FIG. 10 is an enlarged view illustrating the rotation restriction member and its vicinity when an elastic member is attached to a contact surface between the structure and the front cover to reduce an impact.

Further, as shown in FIG. 10, to the contact surfaces 30*b* and 2*b* of the front cover 30 and the structure 2 contacting the rotation restriction member 70, respectively, elastic members 72 are attached, respectively. Hence, an impact created when the front cover 30 is opened and the rotation restriction member 70 contacts the contact surface 30*b* of the front cover 30 and/or the contact surface 2*b* of the structure 2 can be absorbed and reduced by each of the elastic members 72. Here, the elastic member 72 can be only attached to one of the contact surfaces 30*b* and 2B.

Figure 11A:
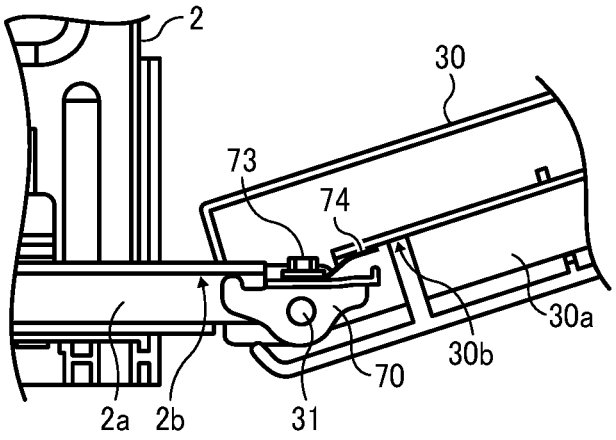
FIG. 11A is a diagram illustrating an aspect when the front cover is opening.
Figure 11B:
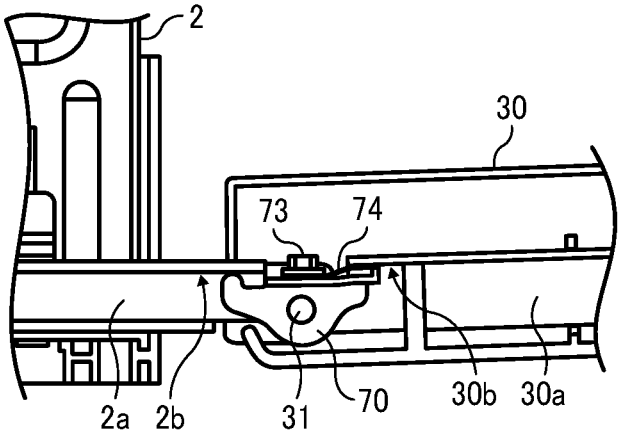
FIG. 11B is a diagram illustrating an aspect when the front cover has been opened.

Further, yet another example to reduce the impact caused when the rotation restriction member 70 contacts the contact surface 30*b* of the front cover 30 is described with reference to FIGS. 11A and 11B.

As shown there, a plate spring 74 is fixed to the rotation restriction member 70 by a screw 73. When the front cover 30 is opened making a given angle, the contact surface 30*b* of the front cover 30 contacts the plate spring 74 as shown in FIG. 11A. Subsequently, as the front cover 30 is further opened, the plate spring 74 is gradually bent and bears the weight of the front cover as shown in FIG. 11B. Hence, since a load applied by the front cover 30 to the rotation restriction member 70 is relaxed by the plate spring 74, the impact caused when the rotation restriction member 70 contacts the contact surface 30*b* of the front cover 30 can be reduced proportionally.

Figure 12A:
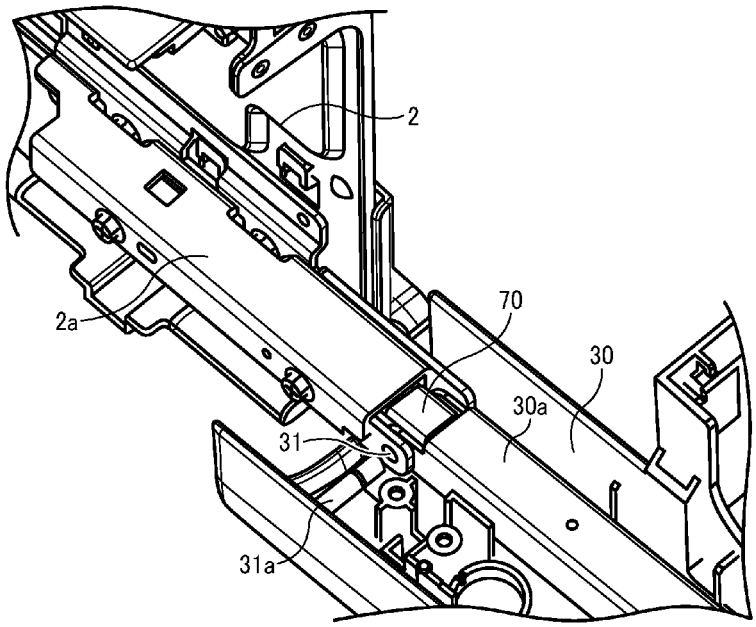
FIG. 12A is an enlarged perspective view illustrating the rotation restriction member and its vicinity when the front cover is opened.
Figure 12B:
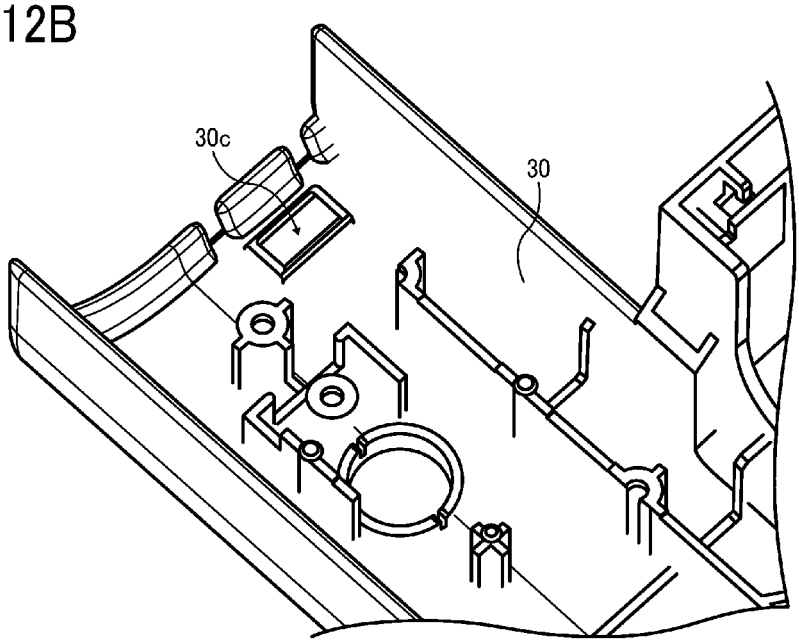
FIG. 12B is an enlarged perspective view illustrating the front cover.
Figure 13:
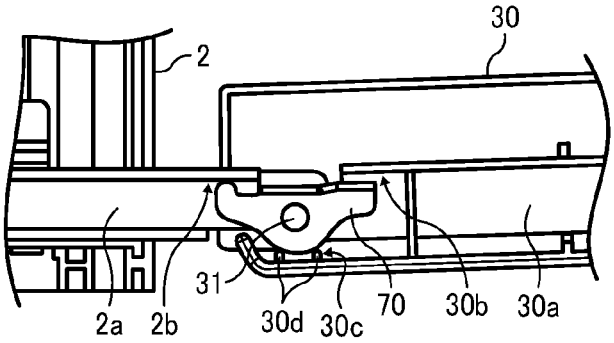
FIG. 13 illustrates an aspect when the rotation restriction member is held by a restriction member holding section included in the front cover.

In this embodiment of the printer 100, when the front cover 30 and the rotation restriction member 70 are assembled in the structure 2, a fulcrum pin 31*a* is inserted to penetrate holes formed in the structure front cover holding section 2*a*, the rotation restriction member 70, and the front cover frame section 30*a* as shown in FIG. 12A. Further, as shown in FIG. 12B, a rotation restriction member holding section 30*c* is provided in the front cover 30 to maintain the rotation restriction member 70 with a pair of ribs 30*d*.

The rotation restriction member holding section 30*c* holds the rotation restriction member 70 with the pair of ribs 30*d* to locate the holes formed in the rotation restriction member 70 and the front cover 30 on the same linier line when the fulcrum pin 31*a* is not yet inserted thereinto.

Hence, since the front cover 30 and the rotation restriction member 70 is able to be assembled in the structure 2 by relatively aligning the holes of the rotation restriction member 70 and the front cover frame section 30*a*, the fulcrum pin 31*a* can be easily attached thereto.

Figure 14A:
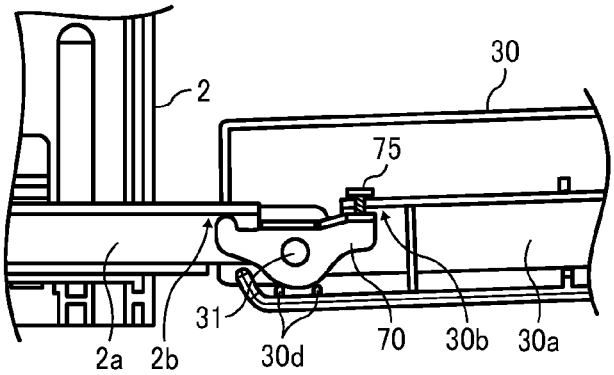
FIG. 14A is an enlarged view illustrating the rotation restriction member and its vicinity when a front cover angle adjustment screw is attached to a front cover frame section and the front cover is opened.
Figure 14B:
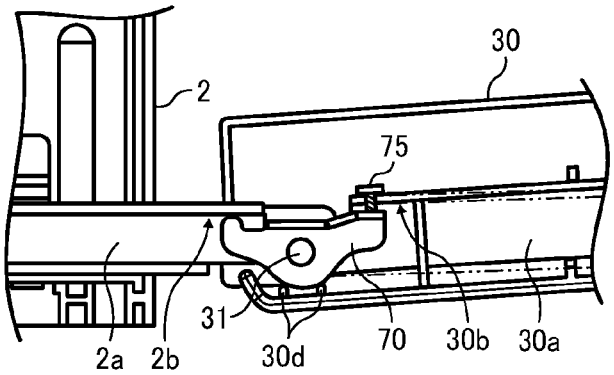
FIG. 14B is a diagram illustrating an aspect when an opening angle is smaller than that in a state of FIG. 14A.

FIG. 14A is an enlarged view illustrating the rotation restriction member 70 and its vicinity when a front cover angle adjustment screw 75 is attached to the front cover frame section 30*a* and the front cover 30 is opened. FIG. 14B is an enlarged view illustrating the rotation restriction member 70 and its vicinity when the front cover 30 is opened by a smaller angle than that in FIG. 14A.

In FIGS. 14A and 14B, the front cover angle adjustment screw 75 is attached to the front cover frame 30*a* to adjust the opening angle of the front cover 30, the opening angle of which is restricted by the rotation restriction member 70. Specifically, when the front cover 30 is opened, a tip of the front cover angle adjustment screw 75 contacts the rotation restriction member 70, and an opening angle of the front cover 30 is restricted in accordance with a contacting position.

Further, when the front cover angle adjustment screw 75 is rotated counterclockwise when viewed from above the apparatus, the tip of the front cover angle adjustment screw 75 parts from the rotation restriction member. Hence, a contact position between the tip of front cover angle adjustment screw 75 and the rotation restriction member 70 moves in a front cover opening direction, so that an opening angle of the front cover becomes increases as shown in FIG. 14A. Accordingly, a variation in opening angle of the front cover 30 caused by uneven parts caused by a manufacturing process can be adjusted by the front cover angle adjustment screw 75. By contrast, when the front cover angle adjustment screw 75 is rotated clockwise when viewed from above the apparatus, the tip of the front cover angle adjustment screw 75 protrudes toward the rotation restriction member. Hence, the contact position between the tip of front cover angle adjustment screw 75 and the rotation restriction member 70 moves in a front cover closing direction, so that an opening angle of the front cover decreases as shown in FIG. 14B.

Hence, the above-described various embodiments of the present invention feature per embodiment as described below.

According to one embodiment of the present invention, an apparatus can be downsized while restricting an opening angle of the pivotable cover.

According to one embodiment, an image forming apparatus includes a structure having an image formation device to form an image, a cover pivotally attached to the structure around a rotary shaft, and an opening angle restricting device to restrict an opening angle of the cover regarding the structure. The opening angle restricting device includes a pivotable cover rotation restriction member coaxially provided with the rotary shaft to contact a downstream side of the pivotable cover in a cover opening direction at its first end to restrict the rotation of the pivotable cover in the opening direction. With this, an opening angle of the pivotable cover can be restricted while downsizing an apparatus.

According to another embodiment of the present invention, the pivotable cover rotation restriction member further includes a second end contacting a contact surface provided in the structure, the second end being arranged on an opposite side of the rotary shaft to the first end. When the pivotable cover is opened and the first end of the pivotable cover rotation restriction member contacts the downstream side of the pivotable cover in the cover opening direction, the pivotable cover rotation restriction member is pressed and rotated by the pivotable cover around the rotary shaft, while the second end of the pivotable cover rotation restriction member contacts the contact surface of the structure and stops rotating and supports the pivotable cover by restricting rotation and an opening angle of the pivotable cover in the opening direction regarding the structure. With this, an opening angle of the pivotable cover can be restricted downsizing an apparatus.

According to another embodiment of the present invention, the pivotable cover rotation restriction member has a prescribed shape determining a relation that a portion of the first end is heavier than a portion of the second end across the rotary shaft. With this, when the pivotable cover is closed, the end of the structure side of the pivotable cover rotation restricting member does not deviate from the end of the pivotable cover, and the pivotable cover rotation restriction member can be entirely installed within the pivotable cover.

According to another embodiment of the present invention, the pivotable cover rotation restriction member has a prescribed shape determining a relation that a portion of the first end is lighter than a portion of the second end. The structure includes a protrusion section to contact and restrict rotation of the pivotable cover rotation restriction member when the pivotable cover is closed. With this, when the pivotable cover is closed, the end of the structure side of the pivotable cover rotation restriction member does not deviate from the end of the pivotable cover, and the pivotable rotation restriction member can be entirely installed within the pivotable cover.

According to another embodiment of the present invention, a spring is provided to connect the pivotable cover rotation restriction member with the pivotable cover to cause an angular moment on the one side of the pivotable cover rotation restriction member around the rotary shaft. The pivotable cover rotation restriction member is shaped so that a portion of the first end is lighter than a portion of the second end across the rotary shaft. With this, when the pivotable cover is closed, the end of the structure side of the pivotable cover rotation restriction member does not deviate from the end of the pivotable cover, and the pivotable rotation restriction member can be entirely installed within the pivotable cover.

According to another embodiment of the present invention, an elastic member is disposed at at least one of a first contact point on the downstream side of the pivotable cover in its opening direction contacted by the pivotable cover rotation restriction member, and a second contact point on the contact surface of the structure contacted by the pivotable cover rotation restriction member. Hence, impact caused when the pivotable cover is opened can be reduced and absorbed by the elastic member.

According to another embodiment of the present invention, the pivotable cover rotation restriction member includes a plate spring contacting the downstream side of the pivotable cover in its opening direction when the pivotable cover is opened. Hence, the impact caused when the pivotable cover is opened can be reduced and absorbed by the spring.

According to another embodiment of the present invention, an opening angle adjusting device is provided to adjust the opening angle of the pivotable cover regarding the structure restricted by the opening angle rotation restricting device. Hence, according to this, since the front cover and the rotation restriction member are assembled in the structure by relatively aligning the holes of the rotation restriction member and the front cover frame section, the fulcrum pin can be easily attached thereto.

According to another embodiment of the present invention, an opening angle adjusting device is to adjust the opening angle of the pivotable cover regarding the structure restricted by the opening angle rotation restricting device. With this, a variation in opening angle of the front cover caused by uneven parts produced during a manufacturing process can be adjusted.

What is claimed is:

1. An image forming apparatus, comprising:

a structure including an image formation device to form an image;

a cover pivotally attached to the structure around a rotary shaft such that the rotary shaft is inside ends of the pivotable cover; and an opening angle restricting device configured to restrict an opening angle of the cover, the opening angle restricting device including a pivotable cover rotation restriction member coaxially arranged with the rotary shaft inside the cover to contact a downstream side of the pivotable cover in a cover opening direction at a first end of the pivotable cover rotation restriction member to restrict the rotation of the pivotable cover in the opening direction, wherein the pivotable cover rotation restriction member further includes a second end contacting a contact surface provided in the structure, the second end being arranged on an opposite side of the rotary shaft to the first end, and when the pivotable cover is opened and the first end of the pivotable cover rotation restriction member contacts the downstream side of the pivotable cover in the cover opening direction, the pivotable cover rotation restriction member is pressed and rotated by the pivotable cover around the rotary shaft, while the second end of the pivotable cover rotation restriction member contacts the contact surface of the structure and stops rotating and supports the pivotable cover by restricting rotation and an opening angle of the pivotable cover in the opening direction.

2. The image forming apparatus as claimed in claim 1, wherein, the pivotable cover rotation restriction member is not exposed from within the opening when the pivotable cover is closed.

3. The image forming apparatus as claimed in claim 1, further comprising an elastic member disposed at at least one of a first contact point on the downstream side of the pivotable cover in its opening direction contacted by the pivotable cover rotation restriction member, and a second contact point on the contact surface of the structure contacted by the pivotable cover rotation restriction member.

4. The image forming apparatus as claimed in claim 1, wherein the pivotable cover rotation restriction member includes a plate spring contacting the downstream side of the pivotable cover in its opening direction when the pivotable cover is opened.

5. The image forming apparatus as claimed in claim 1, wherein the pivotable cover, the structure, and the pivotable cover rotation restriction member, respectively, have multiple holes therein to collectively accept insertion of the rotary shaft when assembled, wherein the pivotable cover includes a holder section to hold the pivotable cover rotation restriction member to align the respective holes of the pivotable cover, the structure, and the pivotable cover rotation restriction member substantially along the same linear line during assembly.

6. The image forming apparatus as claimed in claim 1, further comprising an opening angle adjusting device to adjust the opening angle of the pivotable cover when its rotation is restricted by the opening angle rotation restricting device.

7. The image forming apparatus as claimed in claim 1, wherein a portion of the first end of the pivotable cover rotation restriction member is heavier than a portion of the second end of the pivotable cover rotation restriction member across the rotary shaft.

8. The image forming apparatus as claimed in claim 1, wherein a portion of the first end of the pivotable cover rotation restriction member is lighter than a portion of the second end of the pivotable cover rotation restriction member, wherein the structure further includes a protrusion section to contact and restrict rotation of the pivotable cover rotation restriction member when the pivotable cover is closed.

9. The image forming apparatus as claimed in claim 1, further comprising:

a spring to connect the pivotable cover rotation restriction member with the pivotable cover to create an angular moment on the first side of the pivotable cover rotation restriction member around the rotary shaft, wherein a portion of the first end of the pivotable cover rotation restriction member is lighter than a portion of the second end of the pivotable cover rotation restriction member across the rotary shaft.

10. An openable unit comprising:

a structure including a prescribed device;

a cover pivotally attached to the structure around a rotary shaft such that the rotary shaft is inside ends of the pivotable cover; and an opening angle restricting device to restrict an opening angle of the cover including a pivotable cover rotation restriction member coaxially arranged with the rotary shaft to contact a downstream side of the pivotable cover in a cover opening direction at its first end to restrict the rotation of the pivotable cover in the opening direction, wherein the pivotable cover rotation restriction member further includes a second end contacting a contact surface provided in the structure, the second end being arranged on an opposite side of the rotary shaft to the first end, and when the pivotable cover is opened and the first end of the pivotable cover rotation restriction member contacts the downstream side of the pivotable cover in the cover opening direction, the pivotable cover rotation restriction member is pressed and rotated by the pivotable cover around the rotary shaft, while the second end of the pivotable cover rotation restriction member contacts the contact surface of the structure and stops rotating and supports the pivotable cover by restricting rotation and an opening angle of the pivotable cover in the opening direction.

11. The openable unit as claimed in claim 10, wherein, the pivotable cover rotation restriction means is not exposed from within the opening when the pivotable cover means is closed.

12. The openable unit as claimed in claim 10, further comprising an elastic member disposed at at least one of a first contact point on the downstream side of the pivotable cover in its opening direction contacted by the pivotable cover rotation restriction member, and a second contact point on the contact surface of the structure contacted by the pivotable cover rotation restriction member.

13. The openable unit as claimed in claim 10, wherein the pivotable cover rotation restriction member includes a plate spring contacting the downstream side of the pivotable cover in its opening direction when the pivotable cover is opened.

14. The openable unit as claimed in claim 10, wherein the pivotable cover, the structure, and the pivotable cover rotation restriction member, respectively, have multiple holes therein to collectively accept insertion of the rotary shaft when assembled, wherein the pivotable cover includes a holder section to hold the pivotable cover rotation restriction member to align the respective holes of the pivotable cover, the structure, and the pivotable cover rotation restriction member substantially along the same linear line during assembly.

15. The openable unit as claimed in claim 10, further comprising an opening angle adjusting device to adjust the opening angle of the pivotable cover when its rotation is restricted by the opening angle rotation restricting device.

16. The openable unit as claimed in claim 10, wherein a portion of the first end of the pivotable cover rotation restriction member is heavier than a portion of the second end of the pivotable cover rotation restriction member across the rotary shaft.

17. The openable unit as claimed in claim 10, wherein a portion of the first end of the pivotable cover rotation restriction member is lighter than a portion of the second end of the pivotable cover rotation restriction member, wherein the structure further includes a protrusion section to contact and restrict rotation of the pivotable cover rotation restriction member when the pivotable cover is closed.

18. The openable unit as claimed in claim 10, further comprising a spring to connect the pivotable cover rotation restriction member with the pivotable cover to create an angular moment on the first side of the pivotable cover rotation restriction member around the rotary shaft, wherein a portion of the first end of the pivotable cover rotation restriction member is lighter than a portion of the second end of the pivotable cover rotation restriction member across the rotary shaft.

19. An image forming apparatus, comprising:

means for forming an image;

structure means for accommodating the image forming means;

means for covering a side of the structure means, the covering means pivotally attached to the structure means around a rotary shaft such that the rotary shaft is inside ends of the pivotable cover means; and means for restricting an opening angle of the cover means including a pivotable cover rotation restriction means coaxially arranged with the rotary shaft to contact a downstream side of the pivotable cover means in a cover opening direction at its first end to restrict the rotation of the pivotable cover means in the opening direction, wherein the pivotable cover rotation restriction means further include a second end contacting a contact surface provided in the structure means, the second end being arranged on an opposite side of the rotary shaft to the first end, and when the pivotable cover means are opened and the first end of the pivotable cover rotation restriction means contact the downstream side of the pivotable cover means in the cover opening direction, the pivotable cover rotation restriction means are pressed and rotated by the pivotable cover means around the rotary shaft, while the second end of the pivotable cover rotation restriction means contacts the contact surface of the structure means and stops rotating and supports the pivotable cover means by restricting rotation and an opening angle of the pivotable cover means in the opening direction.

* * * * *